US007713113B2

(12) United States Patent
Chen

(10) Patent No.: US 7,713,113 B2
(45) Date of Patent: May 11, 2010

(54) COIN COUNTER THAT STOPS OPERATING AUTOMATICALLY WHEN OVERLOAD OF THE COINS HAPPENS

(76) Inventor: Chiu-Ming Chen, 45, Kai-an 3rd St., Annan District, Tainan City (TW)

( * ) Notice: Subject to any disclaimer, the term of this patent is extended or adjusted under 35 U.S.C. 154(b) by 0 days.

(21) Appl. No.: 12/193,932

(22) Filed: Aug. 19, 2008

(65) Prior Publication Data

US 2010/0048117 A1 Feb. 25, 2010

(51) Int. Cl.
*G07D 1/00* (2006.01)

(52) U.S. Cl. ..... 453/57

(58) Field of Classification Search ..... 453/18, 453/33, 49, 57

See application file for complete search history.

(56) References Cited

U.S. PATENT DOCUMENTS 4,087,057 A * 5/1978 Sato ..... 242/571.4
6,786,814 B2 * 9/2004 Chen ..... 453/33
7,377,847 B2 * 5/2008 Irie ..... 453/18
2001/0006883 A1 * 7/2001 Abe et al. ..... 453/18
2006/0258278 A1 * 11/2006 Chen ..... 453/57
2007/0066202 A1 * 3/2007 Hu et al. ..... 453/18

* cited by examiner

*Primary Examiner*—Patrick Mackey
*Assistant Examiner*—Mark Beauchaine
(74) *Attorney, Agent, or Firm*—Alan Kamrath; Kamrath & Associates PA

(57) ABSTRACT

A coin counter includes a base frame including a support board, a rotation unit including a rotation disk, a connecting unit including a mounting bracket, and a receiving unit including a receiving seat and a protective plate. Thus, the protective plate is located above the rotation disk of the rotation unit to protect the rotation disk of the rotation unit so as to prevent the coins in the receiving seat from directly contacting and hitting the rotation disk of the rotation unit. In addition, the protective plate of the receiving unit has two opposite sides each supported by the side edge of the receiving seat so that the protective plate of the receiving unit is supported by the receiving seat to bear the heavy load of the coins.

19 Claims, 7 Drawing Sheets

COIN COUNTER THAT STOPS OPERATING AUTOMATICALLY WHEN OVERLOAD OF THE COINS HAPPENS

BACKGROUND OF THE INVENTION

1. Field of the Invention

The present invention relates to a coin counter and, more particularly, to a coin counter for a bank or an amusement ground to count coins.

2. Description of the Related Art

A conventional coin counter comprises a support bracket, a coin outlet port mounted on and connected to the support bracket, a rotation disk rotatably mounted on the support bracket and having a peripheral wall provided with a plurality of receiving grooves to receive a plurality of coins wherein each of the receiving grooves of the rotation disk is movable to approach the coin outlet port to introduce each of the coins into the coin outlet port, a stop bar mounted on the support bracket and located above the coin outlet port to stop movement of the coins so that only one of the coins is allowed to enter the coin outlet port, a rotation shaft rotatably mounted on the support bracket and secured on the rotation disk to rotate the rotation disk, a drive motor mounted on the support bracket and connected to the rotation shaft to rotate the rotation shaft, and an open cover mounted on the support bracket to receive the rotation disk and to allow entrance of the coins. In operation, when the rotation disk is rotated, each of the coins is driven by the respective receiving groove of the rotation disk to pass through the stop bar into the coin outlet port and is delivered outwardly from the coin outlet port. However, when too many coins are accumulated in the cover, the coins press the rotation disk, thereby interfering with rotation of the rotation disk. In addition, when too many coins are accumulated in the cover, the heavy weight of the coins causes a greater burden to the rotation disk, so that the rotation disk is easily worn out or broken.

BRIEF SUMMARY OF THE INVENTION

The primary objective of the present invention is to provide a coin counter that stops operating automatically when overload of the coins happens.

Another objective of the present invention is to provide a coin counter, wherein the protective plate is located above the rotation disk of the rotation unit to protect the rotation disk of the rotation unit so as to prevent the coins in the receiving seat from directly contacting and hitting the rotation disk of the rotation unit.

A further objective of the present invention is to provide a coin counter, wherein the protective plate of the receiving unit has two opposite sides each supported by the side edge of the receiving seat so that the protective plate of the receiving unit is supported by the receiving seat to bear the heavy load of the coins.

A further objective of the present invention is to provide a coin counter, wherein the protective plate has a bent portion facing the conical protrusion of the rotation disk so that the coins falling through the opening of the protective plate are stricken by the rotating conical protrusion of the rotation disk to hit the bent portion of the protective plate and to vibrate and shock the protective plate so as to let go the coins placed on the protective plate and to prevent the coins from being jammed on the protective plate.

A further objective of the present invention is to provide a coin counter, wherein when the load of the coins is too heavy, the receiving seat of the receiving unit and the mounting bracket of the connecting unit are moved downward to press the stop rod so that the stop rod is moved downward to touch the microswitch so as to stop operation of the drive motor and to stop rotation of the rotation disk of the rotation unit automatically.

A further objective of the present invention is to provide a coin counter, wherein the coins passing through the opening of the protective plate are stirred by the rotating conical protrusion of the rotation disk so that the coins are distributed in the passages of the rotation disk evenly and smoothly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
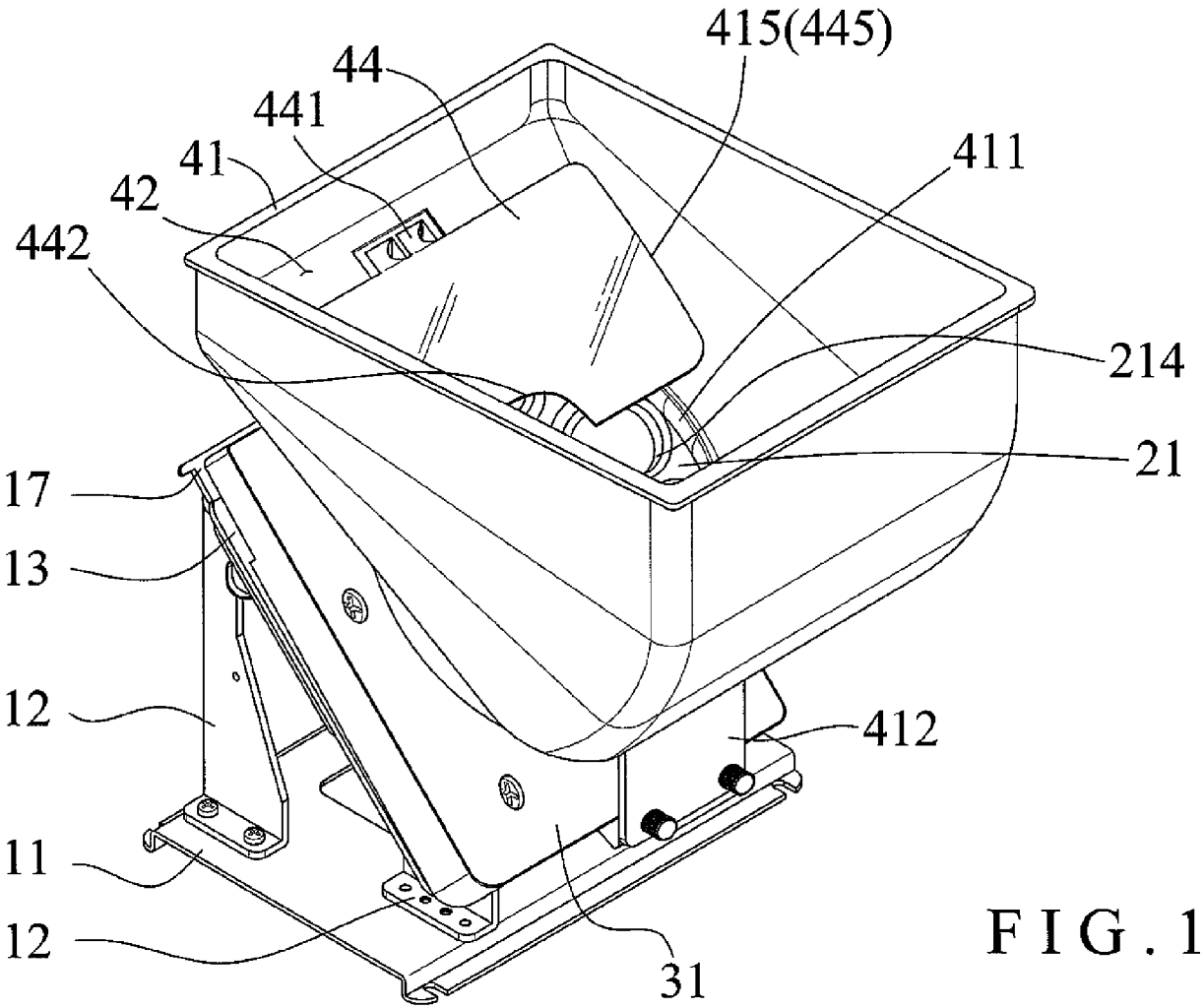
FIG. 1 is a perspective view of a coin counter in accordance with the preferred embodiment of the present invention.
Figure 2:
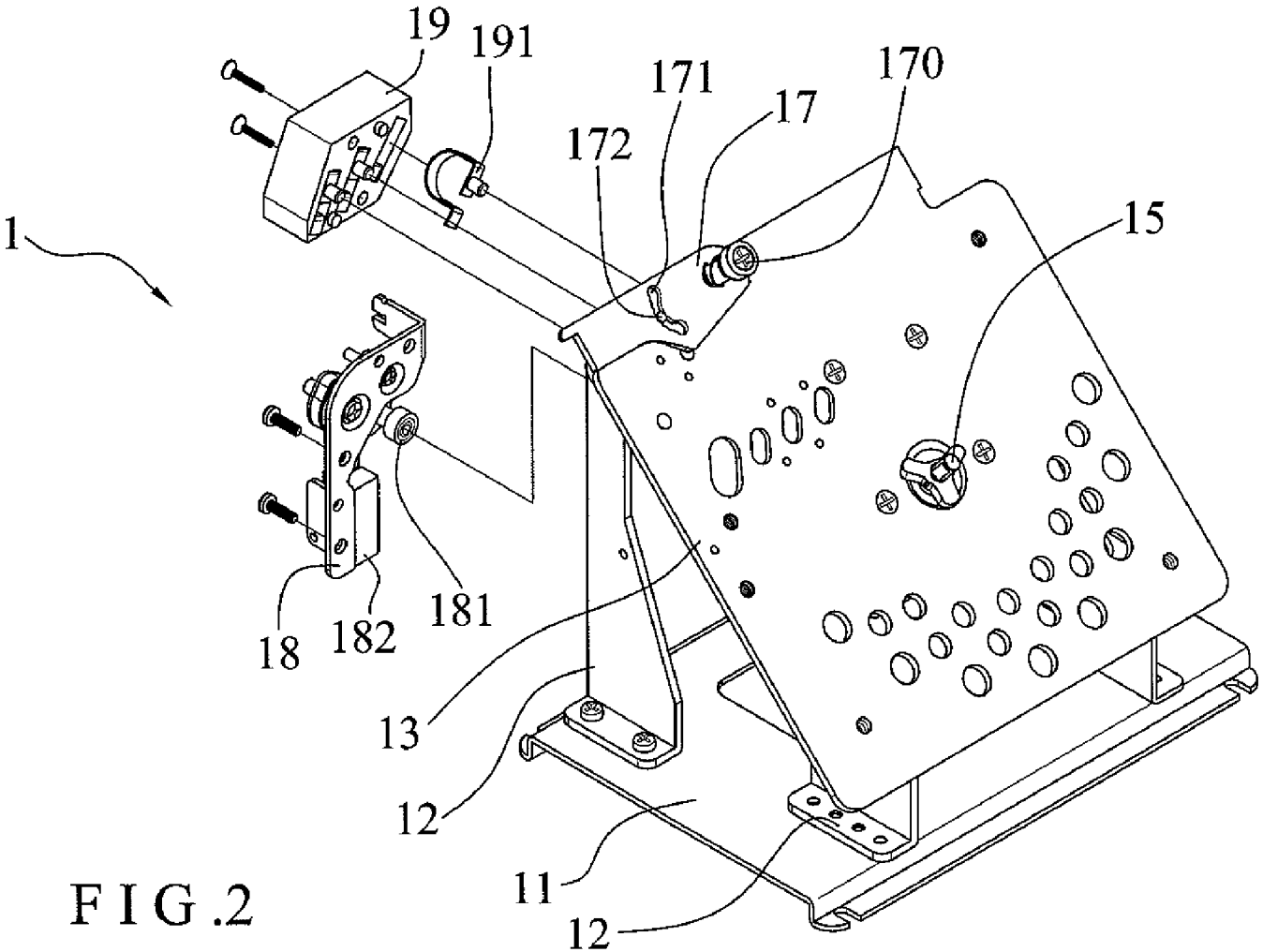
FIG. 2 is a partially exploded perspective view of the coin counter as shown in FIG. 1.
Figure 3:
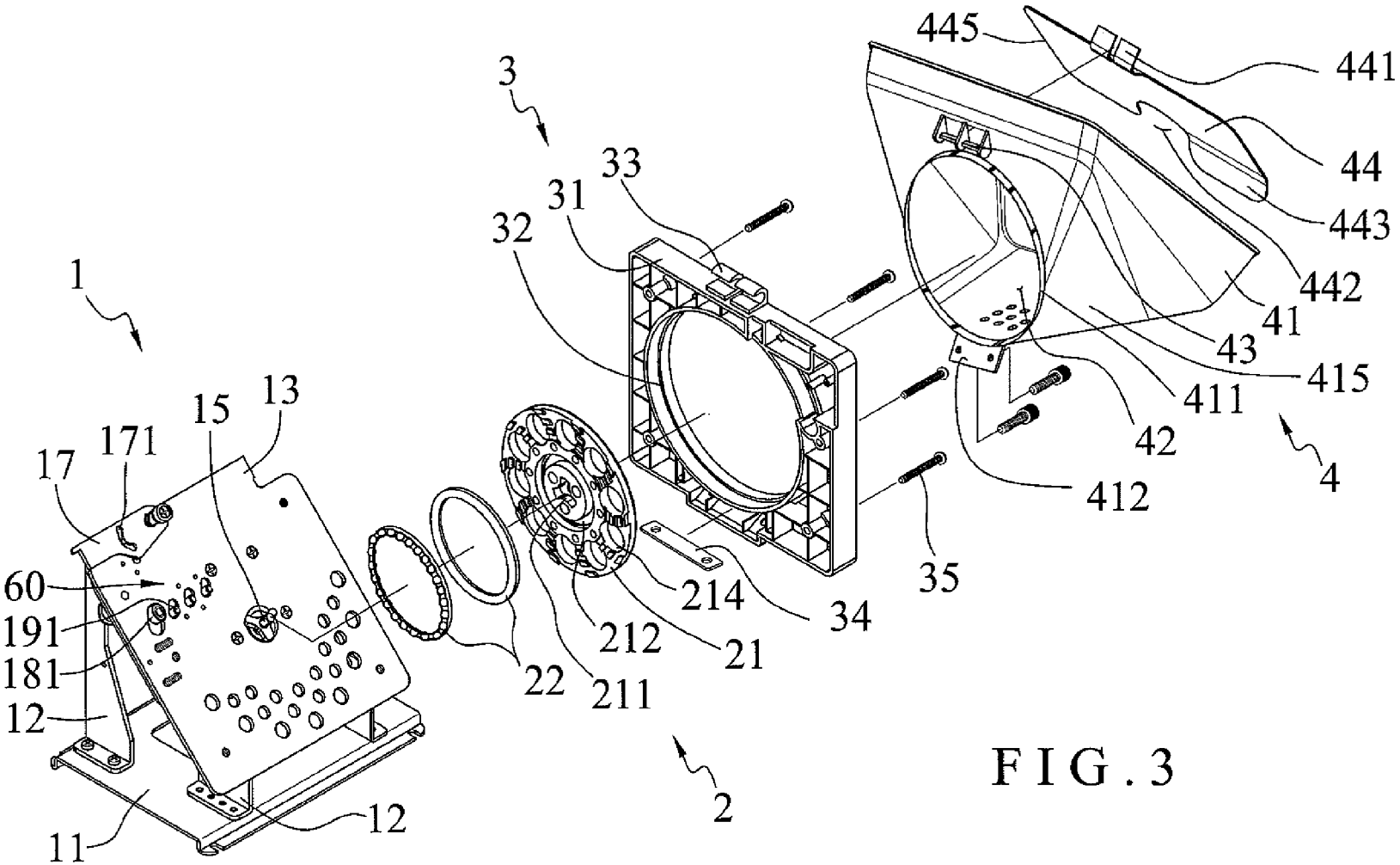
FIG. 3 is an explode perspective view of the coin counter as shown in FIG. 1.

Referring to the drawings and initially to FIGS. 1-6, a coin counter in accordance with the preferred embodiment of the present invention comprises a base frame 1 including a support board 13, a coin outlet port 60 mounted on a side of the support board 13 of the base frame 1, a rotation unit 2 mounted on the base frame 1 and including a rotation disk 21 rotatably mounted on the support board 13 of the base frame 1 and having a periphery provided with a plurality of passages 214 to allow passage of a plurality of coins 5, a coin guide space 61 defined between the rotation disk 21 of the rotation unit 2 and the support board 13 of the base frame 1 and connected between the coin outlet port 60 and one of the passages 214 of the rotation disk 21 to guide a respective coin 5 in one of the passages 214 of the rotation disk 21 into the coin outlet port 60, a coin conveyor 62 mounted on the support board 13 of the base frame 1 and connected to the coin outlet port 60 to convey the coins 5 outwardly, a connecting unit 3 mounted between the base frame 1 and the rotation unit 2 and including a mounting bracket 31 mounted on the support board 13 of the base frame 1 and provided with a mounting hole 32 to receive the rotation disk 21 of the rotation unit 2, and a receiving unit 4 mounted on the connecting unit 3 and including a receiving seat 41 mounted on the mounting bracket 31 of the connecting unit 3 and having a side provided with a connecting hole 411 connected to the mounting hole 32 of the connecting unit 3 to allow passage of the rotation disk 21 of the rotation unit 2, and a protective plate 44 mounted on the receiving seat 41 and located above the rotation disk 21 of the rotation unit 2 to protect the rotation disk 21 of the rotation unit 2 so as to prevent the coins 5 in the receiving seat 41 from directly contacting and hitting the rotation disk 21 of the rotation unit 2.

The base frame 1 further includes a base plate 11, two support brackets 12 mounted on the base plate 11 to support the support board 13, a limit plate 17 adjustably secured on the support board 13 and located in the coin guide space 61, a catch device 19 mounted on the support board 13 and provided with at least one elastic guide member 191 extending into the coin guide space 61 and located opposite to the limit plate 17 to insert and guide each of the coins 5 between the limit plate 17 and the at least one elastic guide member 191 into the coin outlet port 60, a counting device 18 mounted on the support board 13 and located beside the catch device 19 to count a number of the coins 5 passing between the limit plate 17 and the at least one elastic guide member 191 of the catch device 19, a drive member 15 rotatably mounted on a central portion of the support board 13 and secured to the rotation disk 21 of the rotation unit 2 to rotate the rotation disk 21 of the rotation unit 2, and a drive motor 16 mounted on the support board 13 and connected to the drive member 15 to rotate the drive member 15.

The two support brackets 12 of the base frame 1 have different heights to support the support board 13 in an inclined manner. The support board 13 of the base frame 1 is pivotally mounted on an upper one of the two support brackets 12 and is removable outwardly from a lower one of the two support brackets 12. The drive member 15 of the base frame 1 has a substantially Y-shaped profile. The limit plate 17, the catch device 19 and the counting device 18 of the base frame 1 are located between the coin guide space 61 and the coin outlet port 60. The limit plate 17 of the base frame 1 has a first end pivotally mounted on the support board 13 by a bolt 170 and a second end provided with a substantially arc-shaped corrugated guide slot 171, and the base frame 1 further includes an adjusting rod 172 mounted on the support board 13 and slidable in the guide slot 171 of the limit plate 17 when the limit plate 17 is pivotable relative to the support board 13 to adjust the position of the limit plate 17 and to adjust the size of the coin guide space 61 so as to fit coins 5 of different sizes. The counting device 18 of the base frame 1 includes an elastic trigger 181 located between the at least one elastic guide member 191 and the coin outlet port 60 and located opposite to the limit plate 17 to touch the coins 5 passing between the limit plate 17 and the at least one elastic guide member 191 of the catch device 19 into the coin outlet port 60, and a counting member 182 connected to the elastic trigger 181 to count the number of the coins 5 passing between the limit plate 17 and the at least one elastic guide member 191 of the catch device 19 into the coin outlet port 60.

The base frame 1 further includes a microswitch 142 mounted on the lower one of the two support brackets 12 and connected to the drive motor 16 to control operation of the drive motor 16, a stop rod 14 movably mounted on the lower one of the two support brackets 12 and having a first end extending through the support board 13 and connected to the mounting bracket 31 of the connecting unit 3 to move with the mounting bracket 31 of the connecting unit 3 and a second end that is movable to touch the microswitch 142 to stop operation of the drive motor 16 and to stop rotation of the rotation disk 21 of the rotation unit 2, and an elastic member 141 mounted on the stop rod 14 and biased between the support board 13 and the lower one of the two support brackets 12 to push the stop rod 14 to detach from the microswitch 142.

Figure 5:
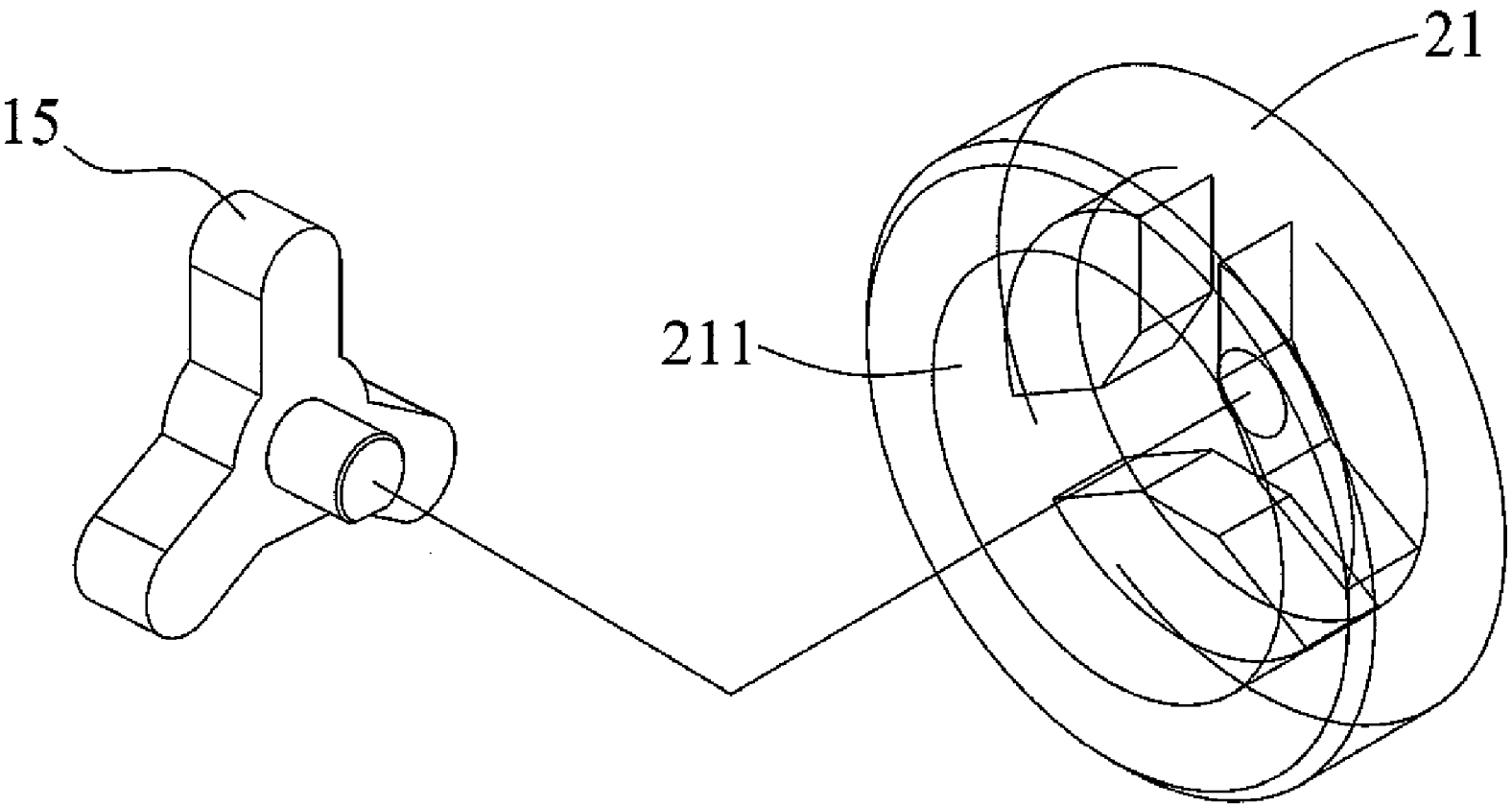
FIG. 5 is a locally enlarged view of the coin counter as shown in FIG. 3.

The rotation unit 2 further includes a bearing 22 mounted between the rotation disk 21 and the support board 13 of the base frame 1. The rotation disk 21 of the rotation unit 2 has a central portion provided with a substantially Y-shaped fixing hole 211 secured on the drive member 15 of the base frame 1 as shown in FIG. 5 so that the rotation disk 21 of the rotation unit 2 is rotatable with the drive member 15 of the base frame 1. The rotation disk 21 of the rotation unit 2 has a first side having a central portion provided with a substantially conical protrusion 213 extending into the receiving seat 41 of the receiving unit 4 and located under the protective plate 44 of the receiving unit 4 and a second side provided with an annular groove 212 located between the passages 214 and the fixing hole 211 to receive the bearing 22.

The connecting unit 3 further includes a locking hook 33 mounted on a first end of the mounting bracket 31 and hooked onto an upper end of the support board 13 of the base frame 1 to attach the mounting bracket 31 of the connecting unit 3 to the support board 13 of the base frame 1, and a fixing piece 34 mounted on a second end of the mounting bracket 31. The mounting hole 32 of the mounting bracket 31 is located between the locking hook 33 and the fixing piece 34. The mounting bracket 31 of the connecting unit 3 is secured on the support board 13 of the base frame 1 by a plurality of locking screws 35 to pivot with the support board 13 of the base frame 1.

The receiving unit 4 further includes a looped mounting portion 43 mounted on a first end of the receiving seat 41 and hooked on the locking hook 33 of the connecting unit 3 to attach the receiving seat 41 of the receiving unit 4 to the mounting bracket 31 of the connecting unit 3, and a locking piece 412 mounted on a second end of the receiving seat 41 and combined with the fixing piece 34 of the connecting unit 3 to secure the receiving seat 41 of the receiving unit 4 to the mounting bracket 31 of the connecting unit 3.

The receiving seat 41 of the receiving unit 4 has a funnel shape and has an inside provided with a receiving chamber 42 connected to the connecting hole 411 to receive the coins 5, the protective plate 44 and the rotation disk 21 of the rotation unit 2. The protective plate 44 of the receiving unit 4 has a first end provided with a hooked piece 441 hooked onto the looped mounting portion 43 to attach the protective plate 44 to the receiving seat 41 and a second end having a middle portion provided with an opening 442 located above the conical protrusion 213 of the rotation disk 21 to allow passage of the coins 5 toward the conical protrusion 213 of the rotation disk 21. The second end of the protective plate 44 has an end portion provided with a recessed bent portion 443 located beside the opening 442 and facing the conical protrusion 213 of the rotation disk 21. The protective plate 44 of the receiving unit 4 is mounted in the receiving chamber 42 of the receiving seat 41 and has two opposite sides 445 each supported by a side edge 415 of the receiving seat 41 so that the protective plate 44 of the receiving unit 4 is supported by the receiving seat 41 to bear the heavy load of the coins 5.

In assembly, the two support brackets 12 are mounted on the base plate 11. Then, the support board 13 of the base frame 1 is pivotally mounted on the upper one of the two support brackets 12 and is removable outwardly from the lower one of the two support brackets 12. Then, the catch device 19 is mounted on the support board 13 with the at least one elastic guide member 191 extending into the coin guide space 61 and being located opposite to the limit plate 17. Then, the drive member 15 is rotatably mounted on the central portion of the support board 13. Then, the drive motor 16 is mounted on the support board 13 and connected to the drive member 15 to rotate the drive member 15. Then, the bearing 22 is received in the annular groove 212 of the rotation disk 21, and the rotation disk 21 is secured on the drive member 15. Then, the mounting bracket 31 is mounted on the support board 13 of the base frame 1, with the mounting hole 32 receiving the rotation disk 21 of the rotation unit 2 and with the locking hook 33 being hooked onto the upper end of the support board 13 of the base frame 1 to attach the mounting bracket 31 of the connecting unit 3 to the support board 13 of the base frame 1. Then, the microswitch 142 is mounted on the lower one of the two support brackets 12, the stop rod 14 is movably mounted on the lower one of the two support brackets 12 and the elastic member 141 is mounted on the stop rod 14 and biased between the support board 13 and the lower one of the two support brackets 12. Then, the receiving seat 41 is mounted on the mounting bracket 31 of the connecting unit 3, with the connecting hole 411 receiving the rotation disk 21 of the rotation unit 2, with the looped mounting portion 43 being hooked on the locking hook 33 of the connecting unit 3 to attach the receiving seat 41 of the receiving unit 4 to the mounting bracket 31 of the connecting unit 3, and with locking piece 412 combining with the fixing piece 34 of the connecting unit 3 to secure the receiving seat 41 of the receiving unit 4 to the mounting bracket 31 of the connecting unit 3. Then, the protective plate 44 is mounted on the receiving seat 41 with the hooked piece 441 being hooked onto the looped mounting portion 43 to attach the protective plate 44 to the receiving seat 41. Finally, the counting device 18 is mounted on the support board 13 and located beside the catch device 19 to finish assembly of the coin counter. It is appreciated that the counting device 18 is assembled finally to prevent the counting device 18 from being worn or broken due to hit during assembly of the coin counter.

Figure 6:
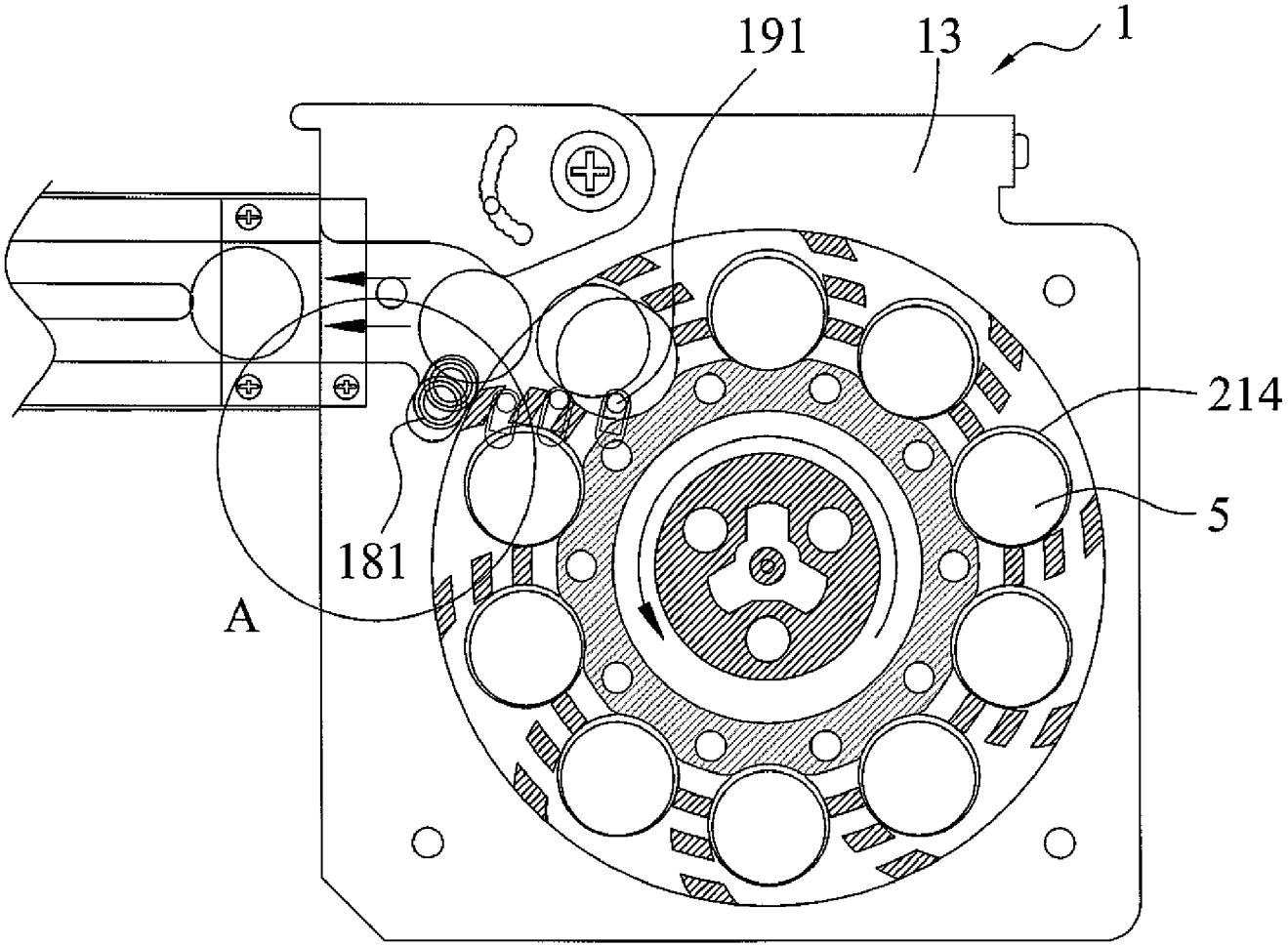
FIG. 6 is a top cross-sectional view of the coin counter as shown in FIG. 1.
Figure 7:
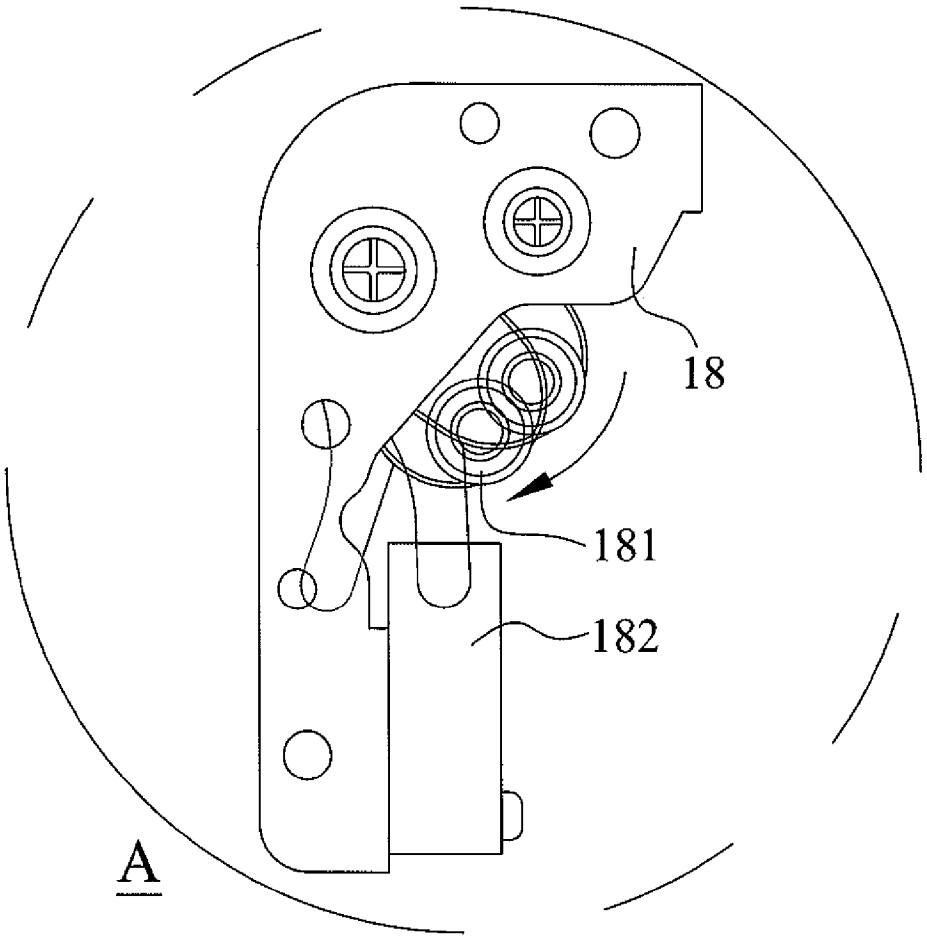
FIG. 7 is a locally enlarged view of the coin counter taken along circle "A" as shown in FIG. 6.

In operation, referring to FIGS. 1-7, the coins 5 fall down into the receiving chamber 42 of the receiving seat 41 and pass through the opening 442 of the protective plate 44 into the rotation disk 21 of the rotation unit 2. Thus, when the rotation disk 21 is rotated by the drive member 15, the coin 5 in each of the passages 214 of the rotation disk 21 is guided through the coin guide space 61, is then inserted between the limit plate 17 and the at least one elastic guide member 191 of catch device 19 into the coin outlet port 60 and is finally conveyed outwardly from the coin conveyor 62 as shown in FIG. 6. At this time, the counting device 18 located beside the catch device 19 is used to count the number of the coins 5 passing between the limit plate 17 and the at least one elastic guide member 191 of the catch device 19 as shown in FIG. 7.

Figure 4:
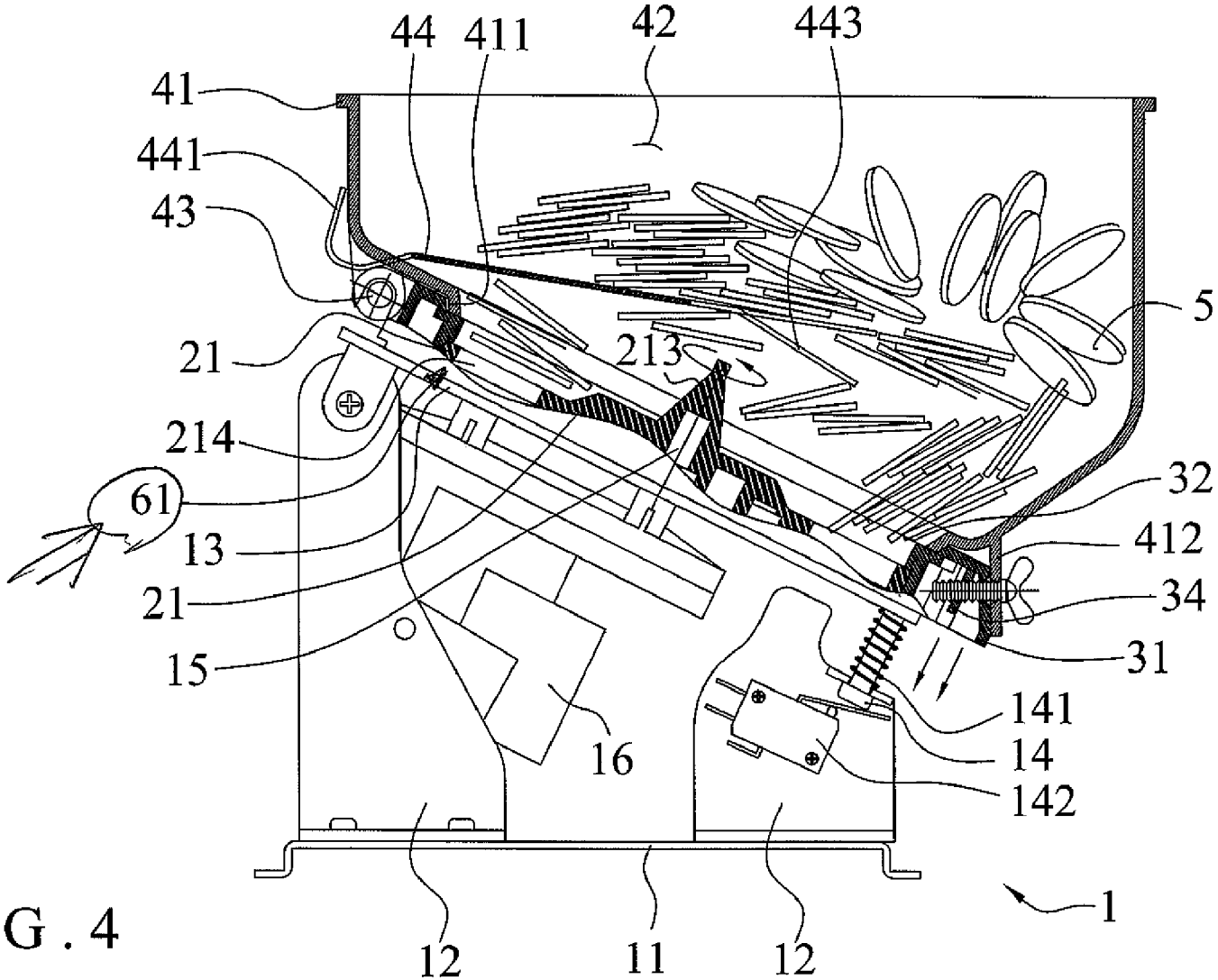
FIG. 4 is a side cross-sectional view of the coin counter as shown in FIG. 1.

Accordingly, the protective plate 44 is located above the rotation disk 21 of the rotation unit 2 to protect the rotation disk 21 of the rotation unit 2 so as to prevent the coins 5 in the receiving seat 41 from directly contacting and hitting the rotation disk 21 of the rotation unit 2. In addition, the protective plate 44 of the receiving unit 4 has two opposite sides 445 each supported by the side edge 415 of the receiving seat 41 so that the protective plate 44 of the receiving unit 4 is supported by the receiving seat 41 to bear the heavy load of the coins 5. Further, the protective plate 44 has a bent portion 443 facing the conical protrusion 213 of the rotation disk 21 so that the coins 5 falling through the opening 442 of the protective plate 44 are stricken by the rotating conical protrusion 213 of the rotation disk 21 to hit the bent portion 443 of the protective plate 44 and to vibrate and shock the protective plate 44 so as to let go the coins 5 placed on the protective plate 44 and to prevent the coins 5 from being jammed on the protective plate 44. Further, when the load of the coins 5 is too heavy, the receiving seat 41 of the receiving unit 4 and the mounting bracket 31 of the connecting unit 3 are moved downward to press the stop rod 14 so that the stop rod 14 is moved downward to touch the microswitch 142 as shown in FIG. 4 so as to stop operation of the drive motor 16 and to stop rotation of the rotation disk 21 of the rotation unit 2 automatically. Further, the coins 5 passing through the opening 442 of the protective plate 44 are stirred by the rotating conical protrusion 213 of the rotation disk 21 so that the coins 5 are distributed in the passages 214 of the rotation disk 21 evenly and smoothly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A coin counter, comprising:

a base frame including a support board;

a coin outlet port mounted on a side of the support board of the base frame;

a rotation unit mounted on the base frame and including a rotation disk rotatably mounted on the support board of the base frame and having a periphery provided with a plurality of passages to allow passage of a plurality of coins;

a coin guide space defined between the rotation disk of the rotation unit and the support board of the base frame and connected between the coin outlet port and one of the passages of the rotation disk to guide a respective coin in one of the passages of the rotation disk into the coin outlet port;

a connecting unit mounted between the base frame and the rotation unit and including a mounting bracket mounted on the support board of the base frame and provided with a mounting hole to receive the rotation disk of the rotation unit;

a receiving unit mounted on the connecting unit and including a receiving seat mounted on the mounting bracket of the connecting unit and having a side provided with a connecting hole connected to the mounting hole of the connecting unit to allow passage of the rotation disk of the rotation unit, and a protective plate mounted on the receiving seat and located above the rotation disk of the rotation unit to protect the rotation disk of the rotation unit;

wherein the base frame further includes:

a base plate;

two support brackets mounted on the base plate to support the support board;

a drive member rotatably mounted on a central portion of the support board and secured to the rotation disk of the rotation unit to rotate the rotation disk of the rotation unit;

a drive motor mounted on the support board and connected to the drive member to rotate the drive member;

a microswitch mounted on a lower one of the two support brackets and connected to the drive motor to control operation of the drive motor;

a stop rod movably mounted on the lower one of the two support brackets and having a first end extending through the support board and connected to the mounting bracket of the connecting unit to move with the mounting bracket of the connecting unit and a second end that is movable to touch the microswitch to stop operation of the drive motor and to stop rotation of the rotation disk of the rotation unit;

an elastic member mounted on the stop rod and biased between the support board and the lower one of the two support brackets to push the stop rod to detach from the microswitch.

2. The coin counter of claim 1, wherein the protective plate of the receiving unit has two opposite sides each supported by a side edge of the receiving seat so that the protective plate of the receiving unit is supported by the receiving seat.

3. The coin counter of claim 1, wherein the support board of the base frame is pivotally mounted on an upper one of the two support brackets and is removable outwardly from the lower one of the two support brackets.

4. The coin counter of claim 3, wherein the two support brackets of the base frame have different heights to support the support board in an inclined manner.

5. The coin counter of claim 1, wherein the connecting unit further includes a locking hook mounted on a first end of the mounting bracket and hooked onto an upper end of the support board of the base frame to attach the mounting bracket of the connecting unit to the support board of the base frame;

the receiving unit further includes a looped mounting portion mounted on a first end of the receiving seat and hooked on the locking hook of the connecting unit to attach the receiving seat of the receiving unit to the mounting bracket of the connecting unit;

the protective plate of the receiving unit has a first end provided with a hooked piece hooked onto the looped mounting portion to attach the protective plate to the receiving seat.

6. The coin counter of claim 5, wherein the rotation disk of the rotation unit has a first side having a central portion provided with a substantially conical protrusion extending into the receiving seat of the receiving unit and located under the protective plate of the receiving unit;

the protective plate of the receiving unit has a second end having a middle portion provided with an opening located above the conical protrusion of the rotation disk to allow passage of the coins toward the conical protrusion of the rotation disk.

7. The coin counter of claim 6, wherein the second end of the protective plate has an end portion provided with a recessed bent portion located beside the opening and facing the conical protrusion of the rotation disk.

8. The coin counter of claim 6, wherein the rotation unit further includes a bearing mounted between the rotation disk and the support board of the base frame.

9. The coin counter of claim 8, wherein the rotation disk of the rotation unit has a second side provided with an annular groove to receive the bearing.

10. The coin counter of claim 9, wherein the drive member of the base frame has a substantially Y-shaped profile;

the rotation disk of the rotation unit has a central portion provided with a substantially Y-shaped fixing hole secured on the drive member of the base frame so that the rotation disk of the rotation unit is rotatable with the drive member of the base frame.

11. The coin counter of claim 10, wherein the annular groove of the rotation disk is located between the passages and the fixing hole to receive the bearing.

12. The coin counter of claim 5, wherein the connecting unit further includes a fixing piece mounted on a second end of the mounting bracket;

the receiving unit further includes a locking piece mounted on a second end of the receiving seat and combined with the fixing piece of the connecting unit to secure the receiving seat of the receiving unit to the mounting bracket of the connecting unit.

13. The coin counter of claim 1, wherein the receiving seat of the receiving unit has an inside provided with a receiving chamber connected to the connecting hole to receive the coins, the protective plate and the rotation disk of the rotation unit;

the protective plate of the receiving unit is mounted in the receiving chamber of the receiving seat.

14. The coin counter of claim 1, wherein the base frame further includes:

a limit plate adjustably secured on the support board and located in the coin guide space;

a catch device mounted on the support board and provided with at least one elastic guide member extending into the coin guide space and located opposite to the limit plate to insert and guide each of the coins between the limit plate and the at least one elastic guide member into the coin outlet port;

a counting device mounted on the support board and located beside the catch device to count a number of the coins passing between the limit plate and the at least one elastic guide member of the catch device.

15. The coin counter of claim 14, wherein the limit plate, the catch device and the counting device of the base frame are located between the coin guide space and the coin outlet port.

16. The coin counter of claim 14, wherein the limit plate of the base frame has a first end pivotally mounted on the support board by a bolt and a second end provided with a substantially arc-shaped corrugated guide slot;

the base frame further includes an adjusting rod mounted on the support board and slidable in the guide slot of the limit plate when the limit plate is pivotable relative to the support board to adjust a position of the limit plate and to adjust a size of the coin guide space so as to fit coins of different sizes.

17. The coin counter of claim 14, wherein the counting device of the base frame includes:

an elastic trigger located between the at least one elastic guide member and the coin outlet port and located opposite to the limit plate to touch the coins passing between the limit plate and the at least one elastic guide member of the catch device into the coin outlet port;

a counting member connected to the elastic trigger to count the number of the coins passing between the limit plate and the at least one elastic guide member of the catch device into the coin outlet port.

18. The coin counter of claim 1, wherein the receiving seat of the receiving unit has a funnel shape.

19. The coin counter of claim 12, wherein the mounting hole of the mounting bracket is located between the locking hook and the fixing piece.

* * * * *